US006543071B1

(12) United States Patent
Lenner

(10) Patent No.: US 6,543,071 B1
(45) Date of Patent: Apr. 8, 2003

(54) FURNITURE FROM CHILDHOOD TO ADULTHOOD USING INTERCHANGEABLE PANELS

(75) Inventor: Mary Jane Lenner, Tinton Falls, NJ (US)

(73) Assignee: Mary J. Lenner, Tinton Falls, NJ (US)

( * ) Notice: Subject to any disclaimer, the term of this patent is extended or adjusted under 35 U.S.C. 154(b) by 0 days.

(21) Appl. No.: 09/967,005

(22) Filed: Sep. 28, 2001

(51) Int. Cl.[7] ..... A47C 19/00; A47C 19/22

(52) U.S. Cl. ..... 5/280; 5/675; 5/2.1; 312/265.6; 312/204

(58) Field of Search ..... 5/280, 675, 2.1; 312/204, 265.6

(56) References Cited

U.S. PATENT DOCUMENTS 2,760,301 A * 8/1956 Derr et al. ..... 160/383
3,129,987 A * 4/1964 Hill ..... 312/204
3,589,788 A * 6/1971 Kaiden ..... 312/204
3,773,399 A * 11/1973 Sulcek ..... 312/204
3,936,107 A * 2/1976 Gourdeau et al. ..... 126/200
4,103,375 A * 8/1978 Santo ..... 312/204
4,103,981 A * 8/1978 Donahue et al. ..... 108/159.11
4,158,277 A * 6/1979 Krempp et al. ..... 312/204
4,448,463 A * 5/1984 Amos ..... 312/111
5,038,427 A * 8/1991 Golden ..... 5/208
5,067,183 A * 11/1991 Urquiola ..... 5/2.1
5,099,988 A * 3/1992 Garran ..... 206/223
5,331,696 A * 7/1994 Armstrong et al. ..... 5/663
5,352,149 A * 10/1994 Melashenko et al. ..... 160/135
5,511,348 A * 4/1996 Cornell et al. ..... 160/351
5,623,800 A * 4/1997 Shinkosky ..... 52/202
5,790,994 A * 8/1998 Leonard ..... 5/53.1
6,053,585 A * 4/2000 Osen ..... 312/204
6,170,200 B1 * 1/2001 Cornell et al. ..... 160/196.1
6,182,307 B1 * 2/2001 Rutrick ..... 5/53.1

* cited by examiner

*Primary Examiner*—J. J. Swann
*Assistant Examiner*—Katherine Mitchell

(57) ABSTRACT

Furniture pieces designed to span maturity of user from post-crib to adulthood by use of interchangeable panels. Furniture is comprised of a frame with interchangeable panels and backing panel that are connected by means of an attachment system. Interchangeable panels are of finishes with themes consistent with various age categories.

8 Claims, 3 Drawing Sheets

FURNITURE FROM CHILDHOOD TO ADULTHOOD USING INTERCHANGEABLE PANELS

FEDERALLY SPONSORED RESEARCH

Not Applicable

SEQUENCE LISTING OR PROGRAM

Not Applicable

BACKGROUND—FIELD OF INVENTION

This panel system relates to furniture, specifically adaptive furniture spanning childhood to adulthood.

BACKGROUND—DESCRIPTION OF PRIOR ART

Most furniture produced is for use exclusively by either children or adults. The problem with furniture intended for children is that it has a limited time span of use, due to styling, design and other considerations. As a child grows, the parents have a dilemma of what to do with furniture that may no longer suit their child's needs or lifestyle, and are unable to integrate it in other areas of the home.

This panel system intends to extend the time span of use of furniture by allowing for interchangeable panels that correspond to the maturity level of the user. Panels indicate maturity of the user by finishes, materials or scenes they depict. In addition, this concept can be used to change the appearance and use of furniture in accordance with changing personal tastes, societal styles and fashions, e.g. a child will often prefer a theme in their room as his/her age changes.

Interchangeable panels are generally known in the prior art and have been used in various applications. U.S. Pat. No. 5,352,149, Malshenko, 1994, uses interchangeable panels in a children's play structure with a limited intent of setting a theme for a play activity. U.S. Pat. No. 5,511,348, Cornell, 1996 and U.S. Pat. No. 6,170,200, Cornell, 2001, use panels in the context of office décor. U.S Pat. No. 5,623,800, Shinkosky, 1997, gives a system interchangeable panels for walls. U.S. Pat. No. 4,103,981, Donohue, 1976, is designed for commercial office (desk) application. U.S. Pat. No. 5,099,988, Garran, 1992 describes an ornamental crib and kit which does not refer to life-size furniture, and U.S. Pat. No. 4,448,463, Amos, 1984, describes an assembly for storage of articles. All are specific cases, which do not address the certain maturity changes in growing children.

To change the identity of the furniture, structural change ideas have also been advanced. U.S. Pat. No. 5,038,427, Golden, 1991, describes a convertible crib-youth bed. However this requires extensive design elements, which add complexity and cost to the item.

OBJECTS AND ADVANTAGES

This interchangeable panel system applies to many types of furniture, including beds, armoirs, end tables, dressers, etc. It addresses the need to change furniture appearance as the users mature and styles change. As an example, an attractive armoir may be chosen to be integrated from a bedroom to a den or library. The mechanical aspects of this system provide for the easy change of panels.

Specifically the advantages of the present invention are;

1. provide flexibility of theme or décor by use of interchangeable panels which will extend the life use of the piece of furniture.

2. provide a cost effective solution to furniture purchases allowing the maximum diversity for the least amount of money
3. provide customization of panels to suit personal taste
4. provide changeable panels which will add flexibility of use to integrate individual pieces in other areas of the home.
5. provide an heirloom piece for the family.
6. provide ease of use for the consumer to change the panels

SUMMARY

The flexibility of interchangeable panels allows a piece of furniture to adapt to the gender and maturity level of the user, from infancy to adulthood. Further, it allows for style and decor changes in an economical manner.

DRAWINGS

Drawing Figures

REFERENCE NUMERALS IN DRAWINGS

Figure 1:
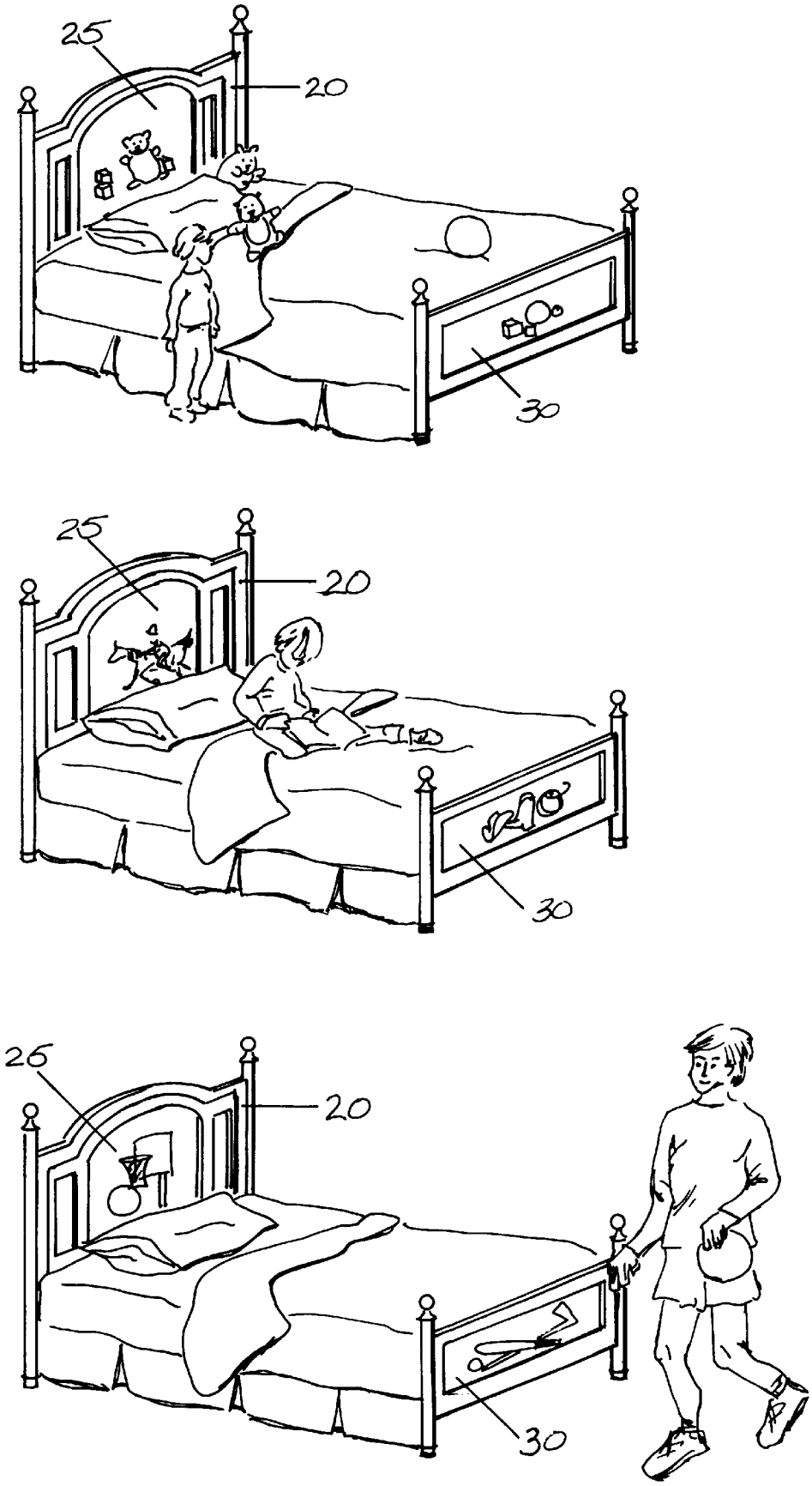
FIG. 1 is a series of three perspective drawings depicting the identical bed in use by the same child throughout different stages of his life.

20 Frame
25 Interchangeable panel—head
30 Interchangeable panel—foot
37 Backing panel
40 Tabletop—interchangeable
44 Armoir panel—interchangeable
50 Drawer front panel—interchangeable
60 Tabs
63 Screws

DETAILED DESCRIPTION

Figure 2:
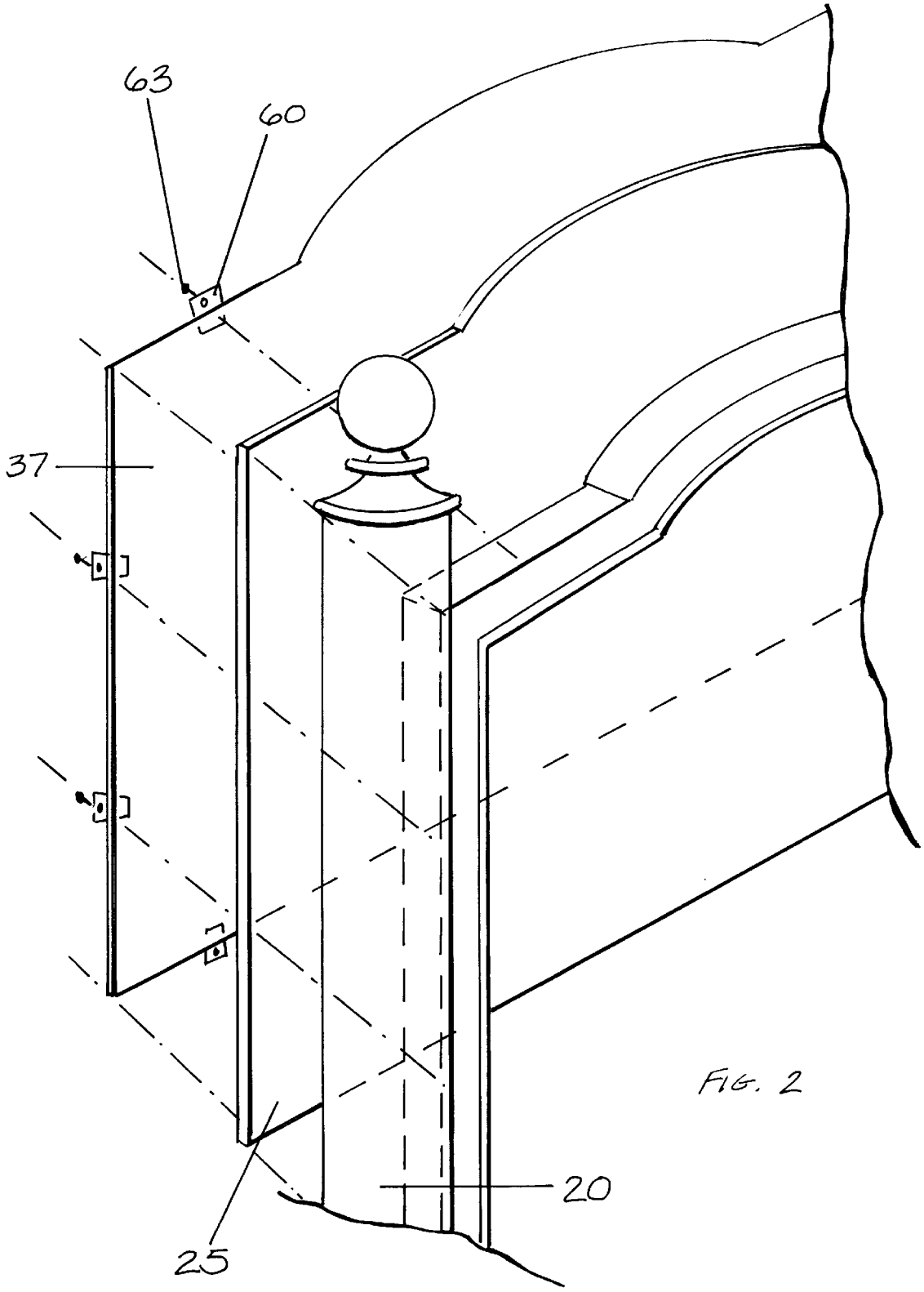
FIG. 2 is a partial sectional perspective showing a typical headboard frame which can be interchanged with different panels to accommodate the age and style desired by the user.

Description—FIGS. 1 and 2—Preferred Embodiment

FIG. 1 shows an overall perspective view series using a bed for the same child at varied ages from post-crib to adulthood using interchangeable panels 25, 30. The bed frame 20 consisting of wood or metal remains unchanged. Style change is accomplished by the substitution of interchangeable panels 25, 30. Backing panel 37 supports the interchangeable panels 25, 30 and can also act as a style panel or match the décor of the frame 20. This figure depicts the adaptability of a piece of furniture suitable to age, gender and decoration desired.

FIG. 2 shows a broken perspective of the bed frame. The interchangeable panel 25, consists of wood or other conventional panel material decorated on each side, and then inserted into the frame 20. The backing panel 37 made of wood or other conventional material holds interchangeable panel 25 flush with the frame. The panel 25 and backing panel 37 are secured by metal or plastic fasteners 60, which are similar in color to the body of the piece of furniture, and are attached to the frame by screws. Decorative finishes on interchangeable panels 25, 30, may be achieved by hand-painting, stain, wallcovering, veneer, upholstery, unfinished for personalizing, or other custom finish. Alternatively, other fasteners, magnetic closures, hinges or attachment mechanisms may be used for securing the panels.

Figure 3:
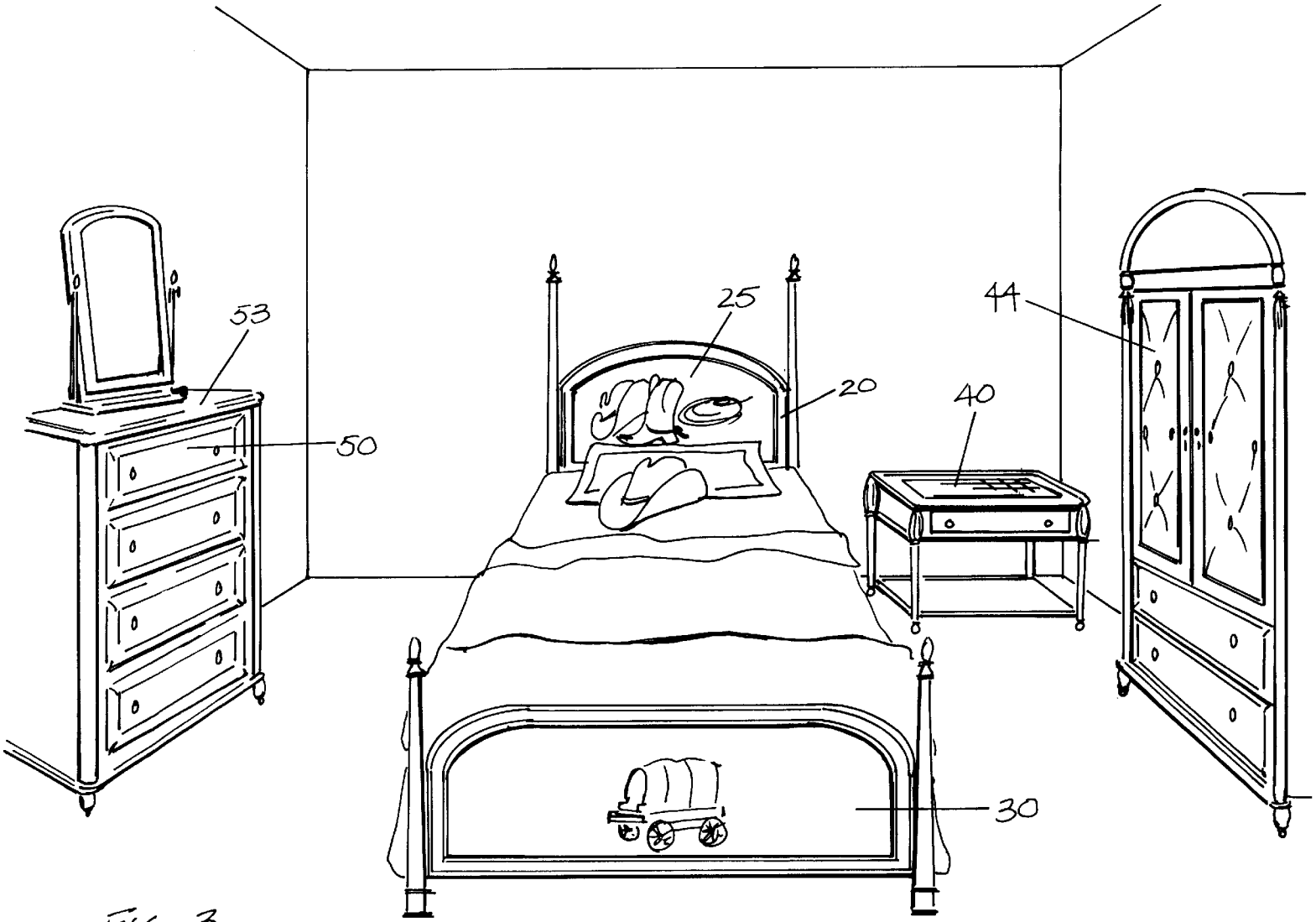
FIG. 3 is a perspective of several typical pieces of furniture, which are each designed to accommodate interchangeable panels. The view shown in this perspective will take a child from a small boy to pre-teen stage.

FIG. 3—Additional Embodiments

Additional embodiments are shown in FIG. 3. Many different types of furniture pieces can be used with interchangeable panels. The panels 25 and 30 are shown in typical use on a headboard and footboard frame. The panel 44 indicates use on an armoir or cabinetry, and panel 50 on drawer fronts. The frames of the furniture may vary in style or material. The interchangeable panels 25, 30, 44, 50 and associated backing panels are used in a vertical or horizontal format, and are fastened by various methods such as tabs, brackets, hinges, or other latch mechanism that provides flexibility and ease of use.

Advantages

From the description above, a number of advantages of my interchangeable panel furniture become evident:

1. The customization of finishes and designs extend the life of the furniture by adapting to several ages, genders, and styles.
2. The panels offer the consumer a variety of finishes and luxury of choice.
3. The interchangeable panels can be produced of economical materials and therefore keep consumer costs down if necessary since they do not require the fine finish of supporting furniture.
4. In the case of wooden furniture the less material which is required will help to alleviate environmental taxation.
5. Interchangeable panels can be purchased separately, and the expense of an entire ensemble of panels can be defrayed over the lifetime of the furnishings, as opposed to a single initial expense.
6. Interchangeable panels can be of different finishes, matching other areas of the home with minimal effort.

Operation—FIGS. 1 and 2

The manner of using the interchangeable panels 25, 30, 44 and 50 as in a vertical format is represented in FIG. 2 as follows. The frame 20 of a typical bed, or piece of cabinetry is constructed with a small recess in the back of the frame. Installation of interchangeable panels 25, 30, 44 or 50 is accomplished by inserting the panels into the recessed ledge of the frame with the decorative side of choice showing. A backing panel 37 is inserted behind the interchangeable panels 25, 30, 44 or 50. Screws 63 on adjoining tabs 60 are then tightened to insure a snug fit to the frame. For removal of the panel, the screws 63 are loosed, and the tabs swiveled to the side and panels removed.

CONCLUSIONS, RAMIFICATIONS AND SCOPE

Accordingly, the reader will see that the use of interchangeable panels in furniture will provide flexibility for the consumer to alter use from age, gender, and décor. This system allows the user to span post-crib to adulthood in an attractive, efficient and cost effective manner. The decorative panels are flexible, can be inserted, turned, removed and disguised with ease of simple closure mechanisms. The panels can be purchased with the furniture or separately and easily integrate into other areas of the home. This system provides a long-term furniture investment which is economical and artistic.

Although the description above contains many specificities, these should not be construed as limitations on the scope of the invention, but rather as providing examples of some presently preferred embodiments of the invention. Many other variations are possible. For example, the panels may be of different quality or material depending on the level of the furniture manufactured. Specific themes may be chosen for mass production, or custom finishes/theme provided. The attachment mechanisms for the panel to frame will include those mentioned above and other varieties. The panels can be adapted to current, future and custom furniture design, etc. Therefore, the scope of the invention should be determined by the appended claims and their legal equivalents, rather than by the examples given.

I claim:

1. Articles of residential furniture that change in appearance periodically to be consistent with the maturity of the users thereof, comprising:

a) structural frames with openings that constitute a significant fraction of the visible surfaces, b) a collection of maturity based decorative panel sets, where each set corresponds to an age category, and each set is insertable in said openings and interchangeable with any other set, c) anchoring mechanisms on the structural frames to affix the maturity based decorative panel sets.

2. The articles of furniture of claim 1 wherein said furniture is for sleeping.

3. The articles of furniture of claim 1 wherein said furniture is for storage.

4. The maturity based decorative panel sets of claim 1, wherein said panel sets consist of one or more panels that correspond to the maturity level of the user of that piece of furniture.

5. The collection of maturity based decorative panel sets of claim 1, wherein said collections correspond in theme from at least two categories selected from a group consisting of baby, infant, toddler, young child, child, pre-teen, teenage, and adult development levels.

6. The decorative panels of claim 1, wherein said panels are made of wood, plastic, composites, or metal and are decorated by painting, silk screening, carved, embossed, inlaid, branded, upholstered, wall papered, veneered, or decorated by photographic duplication techniques.

7. The anchoring mechanisms on the structural frames of claim 1 wherein said mechanisms are swiveling tabs.

8. Articles of residential furniture that change in appearance periodically to be consistent with the maturity of the users thereof, comprising:

a) structural frames with openings that constitute a significant fraction of the visible surfaces, b) a collection of maturity based decorative panel sets, where each set corresponds to an age category, and each set is insertable in said openings and interchangeable with any other set, c) anchoring mechanisms on the structural frames to affix the maturity based decorative panel sets, d) are assembled as a plurality of furniture pieces to define the maturity level of an entire room.

* * * * *